United States Patent [19]

Kawai

[11] 4,013,358

[45] Mar. 22, 1977

[54] DEVICE FOR ADJUSTING STARTING POSITION FOR TRANSFER-TYPE ELECTROPHOTOGRAPHIC REPRODUCING APPARATUS HAVING BELT-LIKE PHOTOSENSITIVE MEMBER

[75] Inventor: Yoshihisa Kawai, Hommachi, Japan

[73] Assignee: Minolta Camera Kabushiki Kaisha, Osaka, Japan

[22] Filed: Aug. 18, 1975

[21] Appl. No.: 605,736

[30] Foreign Application Priority Data

Sept. 2, 1974 Japan ..... 49-105715[U]

[52] U.S. Cl. ..... 355/14; 355/16

[51] Int. Cl.[2] ..... G03G 15/00

[58] Field of Search ..... 355/16, 14, 3 BE

[56] References Cited

UNITED STATES PATENTS

| | | | |
|---|---|---|---|
| 3,521,950 | 7/1970 | Gardner et al. | 355/3 BE |
| 3,797,930 | 3/1974 | Tanaka et al. | 355/16 X |
| 3,976,375 | 8/1976 | Kurita et al. | 355/14 |

OTHER PUBLICATIONS

"An Electrographic Printer with Asynchronous Image Belt," IBM Technical Disclosure Bulletin, vol. 9, No. 11, Apr. 1967, p. 1526.

*Primary Examiner*—L. T. Hix
*Assistant Examiner*—Kenneth C. Hutchison
*Attorney, Agent, or Firm*—Wolder & Gross

[57] ABSTRACT

A belt-type photocopy machine in which the belt assembly is disconnectable from the belt drive and withdrawable to an external location for replacement of the belt. The belt is seamed, but the removable assembly contains belt-position-defining elements with which the seam in the belt is aligned during replacement, and the machine's copy sequence controls cooperate with the position-defining elements through synchronizing means upon reinsertion of the belt assembly so that coordination of the sequence controls and the belt position is achieved regardless of the relative positions of the belt and the sequence controls subsequent to reinsertion.

13 Claims, 2 Drawing Figures

DEVICE FOR ADJUSTING STARTING POSITION FOR TRANSFER-TYPE ELECTROPHOTOGRAPHIC REPRODUCING APPARATUS HAVING BELT-LIKE PHOTOSENSITIVE MEMBER

BACKGROUND OF THE INVENTION

1. Field of the Invention

This invention relates to a device for adjusting the starting position of a belt-like photosensitive member for use in a transfer-type electrophotographic reproducing apparatus. More particularly, it relates to one in which the belt-like photosensitive member (hereinafter referred to as a photosensitive belt) has a joint portion, or seam, and is trained about rollers to form a photosensitive member unit, the unit being removably mounted in the main body of the reproducing apparatus.

2. Discussion of the Prior Art

In a transfer-type electrophotographic reproducing apparatus, the support of the photosensitive member is generally classified into the drum type and the belt type, either of which is adapted to be withdrawn from the main body of the reproducing apparatus for maintenance of the photosensitive member. If a photosensitive belt has a joint, i.e., is not seamless, then it is imperative to locate this joint at a particular position at the time of commencement of reproduction, so that the joint cannot be included in an image area. On the other hand, if a drum type photosensitive member has a joint (or discontinuity), proper positioning of the joint is achieved with ease by merely providing a positioning pin on the drum shaft.

A difficulty has been encountered with the belt-type photosensitive member in that withdrawal of a roller shaft from the main body of the reproducing apparatus is difficult from the viewpoint of the mechanism. For this reason, a device has been proposed, (for example, Utility Model Application No. 48-135,998 filed in Japan in 1973 by the assignee of this application) in which a photosensitive belt and a roller shaft are integrally formed into a photosensitive member unit, and this unit is removably mounted in the main body of the reproducing apparatus with a gear train serving as a drive source, which gear train is incorporated in the main body. In that device, the photosensitive belt is adjusted so as to locate its joint at a particular position beforehand while the unit is outside the reproducing apparatus and then the unit is set in place in the main body of the reproducing apparatus. Another difficulty has been encountered with that device, however, in that because the roller shaft must be connected to a drive source by way of gears, at the time of such connection it frequently arises that the position of the joint is not in accord with the position of a reproduction sequence controlling mechanism, resulting in the necessity to readjust the position of the joint.

The present invention is directed to avoiding the above-mentioned difficulties.

SUMMARY OF THE INVENTION

It is accordingly an object of the invention to provide an improved tranfer-type electrophotographic reproducing apparatus. The apparatus has an image-forming system, a photosensitive member unit mounted for withdrawal from and insertion into the apparatus, the unit containing a photosensitive belt having a seam and being trained about a plurality of rollers for rotation to at least one position in an area receiving an image from the image-forming system when reproduction is initiated, and a drive source adapted for engaging at least one of the rollers for providing the rotation, the engaging of the drive source with the one roller being conditionally enabled upon insertion of the unit into the apparatus and being disabled upon withdrawal therefrom. The improvement comprises combining the above apparatus with a device for adjusting a starting position of the belt, including a belt-position control member mounted in the unit for synchronous movement with the belt and adapted to occupy a discrete position with the seam located at a given position outside the image-receiving area, first means enabling the engaging of the drive source with the one roller in response to movement of the belt-position control member from the discrete position, means disabling the first enabling means when the control member is in the discrete position, second means enabling the engaging of the drive source with the one roller in response to initiated reproduction and means inhibiting the second enabling means, said last means being effective in the absence of the control member from the discrete position, whereby the seam is prevented from occupying the image area during reproduction and reproduction initiation is prevented when the seam is in the image area.

BRIEF DESCRIPTION OF THE DRAWING

Description of an embodiment of the present invention will be given with reference to the accompanying drawing, in which.

DETAILED DESCRIPTION OF THE INVENTION

Figure 1:
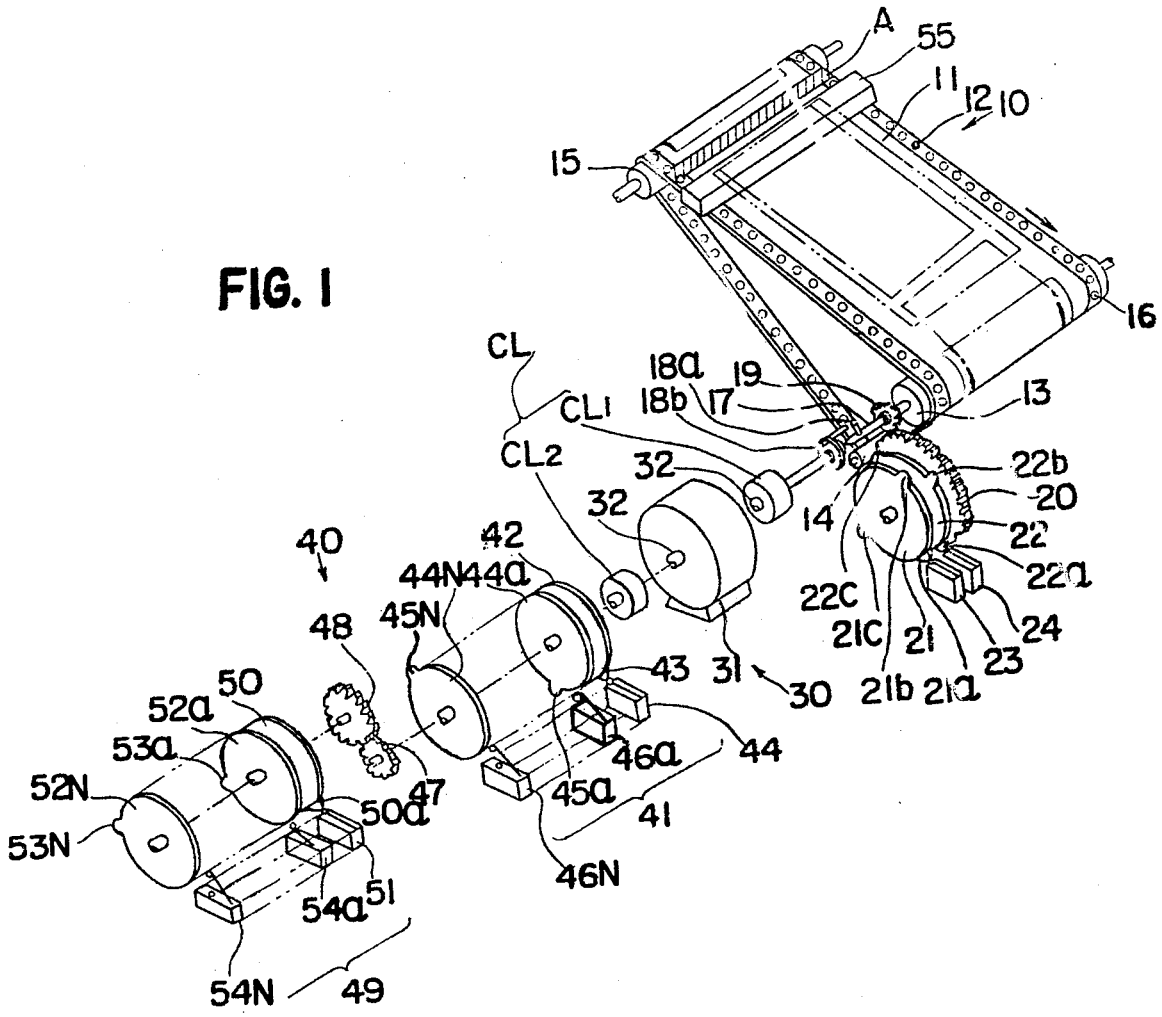
FIG. 1 is an exploded perspective view of a device for adjusting a starting position according to the present invention.

Referring first to FIG. 1, a device for adjusting the starting position of a belt-like photosensitive member according to the present invention is generally composed of a photosensitive member unit 10, a drive source 30, a group of reproduction-controlling cams 40 and a clutch mechanism CL.

The photosensitive member unit 10 comprises a drive roller 13 and two driven rollers 14, 15 rotatably mounted on opposing side frames (not shown) which frames are mounted in the main body (also not shown) in a manner to be withdrawn therefrom (along slide rails, say), and a photosensitive belt 11 is trained about the above-mentioned drive and driven rollers, the roller axes being positioned in parallel, triangular relation to one another. Photosensitive belt 11 is rotated in the direction of the arrow shown at the right in FIG. 1, by virtue of perforations provided along each longitudinal edge 12 of the belt, which perforations are maintained in engagement with pins 16 provided at each side of drive roller 13. A mechanical clutch 18*a*, *b* comprises a pin 18*a* attached radially near one end of shaft 17 extending coaxially from drive roller 13. Pin 18*a* is adapted to disconnectably engage with a lateral projection (shown, but not numbered) on a disc 18*b* mounted on the end of a shaft driven by a main motor 31 (forming part of drive source 30 to be described later), so that the photosensitive member unit 10 may be set in or removed from the main body of the reproducing apparatus.

A gear 19 is mounted on extension shaft 17 in meshing relation with a gear 20 rotatably mounted in the side frame of the unit and being provided with cams 21 and 22 rigidly affixed thereto. Cam 21 has four projections or lobes 21*a*, 21*b*, 21*c* and 21*d* (not visible in FIG. 1), and cam 22 has three projections or lobes 22*a*, 22*b* and 22*c*. Show at 23 and 24 are respective microswitches opened and closed by cams 21 and 22, hereinafter referred to as the belt-position-adjusting cams. Both cams 21 and 22 are so arranged that projections 21*a* and 22*a* take the same angular position on the circumference of the respective cam. The number of projections 21*a* to 21*d* and 22*a* to 22*c* of the respective cams accords with the number of copies of the corresponding size which are obtainable from the entire usable surface of photosensitive belt 11. For example, in case A-4 size copy paper is being used, four sheets of copy are obtained from the photosensitive belt length, whereas three sheets of copy are obtained in the case of B-4 size copy paper, as shown respectively by the outlines in a one-dot chain line and in a two-dot chain line in FIG. 1.

First and second electromagnetic clutches CL1 and CL2 are mounted on a motor shaft 32 projecting from each side of the main motor 31 incorporated in the main body.

an array of reproduction-controlling cams 40 consists of a group of A-4 size reproduction-controlling cams 41 connected to main motor 31 through the intermediary of the second electromagnetic clutch CL2, and a group of B-4 size reproduction-controlling cams 49 connected therewith by the intermediary of reduction gears 47 and 48. Each group of reproduction-controlling cams comprises a reproduction-starting-position defining cam 42 (or 50) and a plurality of cams 44*a* to 44N (or 52*a* to 52N) which activate reproducing elements such as exposure and charging elements in response to the movement of belt 11, the cam lobes actuating respective microswitches 44, 46*a* to 46N and 51, 54*a* to 54N, thereby establishing a starting position on belt 11 and a commencement of reproduction condition for the cams.

Additionally, there are provided (only the first device being shown) a charger 55 on the upper portion of belt 11 toward the rear of unit 10, exposure means above belt 11 toward the front of unit 10, a developing device in the vicinity of drive roller 13, a transfer station adjacent belt 11 in the vicinity of driven roller 14, and a cleaning station below belt 11 near roller 15, all of which are secured to the main body of the reproducing apparatus in the positions described, so that one cycle of the reproducing process may be completed through one cycle of rotation of belt 11. Thus, for obtaining two sheets of copy through a continuous reproduction, belt 11 effects one and one-fourth rotation for A-4 size (or one and one-third rotation for the larger size copy).

The group of reproduction-controlling cams 41 effect one cycle of rotation during one-fourth rotation of belt 11, whereas the group of cams 49 undergo one cycle of rotation during one-third rotation of belt 11 because of the reduction gears 47, 48.

In FIG. 1, a joint A in belt 11 is shown behind charger 55 (in terms of the direction of the arrow) at a position which is an initial one, i.e., prior to commencement of reproduction. With joint A maintained in that position, projections 21*a* 22*a* of belt-position-adjusting cams 21 and 22 are set at a position such that they actuate their respective microswitches 23 and 24.

Operation of the device for automatically adjusting the starting position of belt 11 will now be described in conjunction with the electric circuit shown in FIG. 2. The switch conditions shown in FIG. 2 correspond to the belt and cam positions shown in FIG. 1 and the case where the operator has selected B-4 size copies for production.

A switch 51 operated by cam 50 for use in establishing the starting position of a B-4 size reproduction is connected to the contacts NO of a normally-open switch 56. This latter switch is used in selecting the size of copying paper, i.e., either an A-4 size reproduction or a B-4 size reproduction. Conversely, a switch 44 operated by cam 42 for use in establishing the starting position of an A-4 size reproduction is connected to the normally-closed contact side NC of switch 56. The normally-open contact side NO of switch 51 is connected to a starting switch 23 establishing a starting position of belt 11 for each B-4 size reproduction, and the normally-open contact NO of switch 44 is connected to a starting switch 24 establishing a starting position on belt 11 for an A-4 size reproduction, while the normally-closed contacts NC of switches 44 and 51 are both connected to the second electromagnetic clutch CL2. The normally-open contact sides NO of starting switches 23 and 24 are both connected through a reproduction starting switch 57 to an input terminal 59 of a control circuit 58, and the normally-closed contact sides NC of starting switches 23 and 24 are connected to the first electromagnetic clutch CL1.

Shown at 60 is an output terminal of the control circuit 58, the output terminal being connected through diodes 61, 61' to the first and second electromagnetic clutches CL1 and CL2, respectively.

Figure 2:
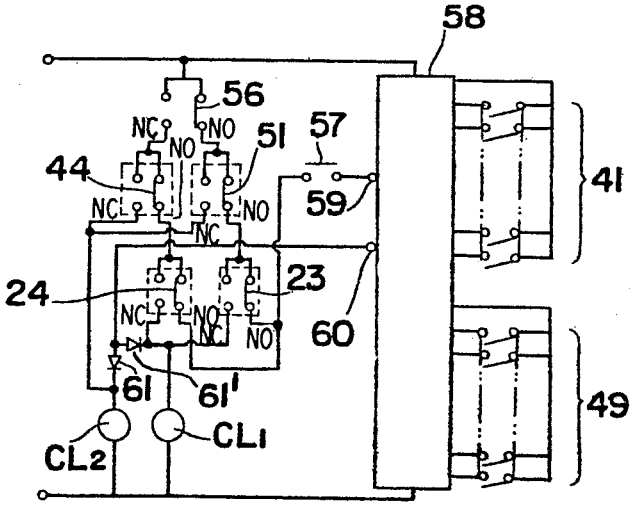
FIG. 2 is a circuit diagram.

In operation, a power switch (not shown) is thrown to energize main motor 31 and other circuits in known fashion and, say, the selection switch 56 is set to the position for effecting an A-4 size reproduction (i.e., opposite to that shown in FIG. 2). At this time, if the group of cams 41 are not located at the starting position where projection 43 of starting-position-defining cam 42 is in engagement with switch 44 (i.e., if they are not located as shown in FIG. 1), this will cause electric current to flow through the normally-closed contact NC (switch 44 then being in the position opposite to that shown in FIG. 2) to activate the second electromagnetic clutch CL2, whereby drive from main motor 31 is transmitted to the group of cams 41, thereby rotating same. When the group of cams 41 assume the start position (that shown in FIG. 1), the projection 43 of starting-position-defining cam 42 pushes the actuator arm of start switch 44, whereby the normally-closed contact NC of switch 44 is opened, thereby interrupting electric current to the second electromagnetic clutch CL2, such that the group of cams 41 stop at that position.

On the other hand, if the seam A of sensitive belt 11 is not at the starting position, i.e., if the lobe 22*a* (or one of the other lobes 22*b*, *c*, *d*) of belt-position-adjusting cam 22 is not in engagement with starting switch 24, electric current will flow through the normally-closed contact side NC of switch 24 to the first electromagnetic clutch CL1, thereby causing main motor 31 to drive shaft 17 (through mechanical clutch 18*a*, *b*) whereby belt 11 is rotated. When belt 11 arrives at the starting position shown in FIG. 1, for example, then by virtue of gears 19, 20 the lobe 22*a* of belt-position-adjusting cam 22 simultaneously arrives at a point where it engages starting switch 24, with the result that normally-closed contact NC is opened to interrupt thereby the electric current to first electromagnetic clutch CL1, such that belt 11 stops at the starting position shown in FIG. 1.

At this time, both the group of cams 41 and also the belt 11 have assumed a starting position for an A-4 reproduction. If the reproduction starting switch 57 is then actuated, a signal is fed through the NO contacts of switches 44 and 24 — recalling that for purposes of this description the operator was assumed to have selected A-4 reproduction size and thus switch 56 is in the position opposite to that shown in FIG. 2, i.e., the NC contacts are closed — to the input terminal 59 of control circuit 58, thereby commencing reproduction.

When reproduction starts, electric current flows from the output terminal 60 of circuit 58 through the diodes 61, 61' to activate the first and second electromagnetic clutches CL1 and CL2, causing belt 11 and the groups of cams 41 and 49 to rotate. Since the selection switch 56 has been set for A-4 size reproduction, for purposes of this description, the control circuit 58 is activated (see FIG. 1) in known fashion according to the opening and closing of switches 46*a* to 44N in the group of cams 41, so that charging, exposure, developing and transfer signals are sequentially given to corresponding elements, reproduction thus being achieved.

Toward completion of reproduction, electric current flowing from output terminal 60 in control circuit 58 to the first and second electromagnetic clutches CL1 and CL2 is interrupted. Consequently, if cams 41 and belt 11 are not at a starting position, electric current flows through the copy-size selection switch 56 and the starting-position switches 44 and 51 to the first and second electromagnetic clutches CL1 and CL2. When belt 11 and the group of cams 41 come to a starting position, electric current to the first and second electromagnetic clutches CL1 and CL2 is cut off, thereby stopping belt 11 and cams 41 in those positions, as set forth in the foregoing. Thus, belt 11 and starting-position switches 44 and 51 remain in respective starting condition until a subsequent reproduction commences.

If selection switch 56 is set for selecting a B-4 size copy, reproduction is achieved through the same procedures as described.

In the above-described reproduction, because one cycle of the reproducing process is completed through one cycle of rotation of photosensitive belt 11, the joint A of belt 11 would have rotated through one and one-fourth rotation after two successive copyings of A-4 size. In order to effect a B-4 size reproduction at that time, the joint must be moved out of the B-4 imaging area it occupies, and accordingly reproduction of B-4 size is initiated only subsequent to rotation of joint A to the closest optimum position for B-4 size reproduction. The rotation is achieved by virtue of switch 23 being in normally-closed condition such that clutch CL1 is energized through the NO contacts of copy-size selection switch 56 and B-4 size reproduction-starting-position-defining switch 51 (condition as show in FIG. 2). The NC contacts of switch 23 are in a condition opposite to that shown in FIG. 2 because belt 11 stopped at a position where A-4 cam 21 for adjusting the position of belt 11 was effecting control.

As is apparent from the foregoing, according to the present invention, the photosensitive belt 11 and groups of reproduction controlling cams 41, 49 are connected to the drive source 30 by means of separate clutches CL1, CL2. Even if photosensitive belt 11 and the groups of reproduction controlling cams 41, 49 are initially in an improper position, both are automatically shifted to a normal start position. Inasmuch as belt 11 is trained about the unit 10 with its joint A located at a starting position common to various size reproduction, which position is behind the charger 55 (when viewed as in FIG. 1), and the lobes 45*a*-45N of the element-operating cams 44*a*-44N, etc. aligned with each other assume a position to operate respective switches, even if there is a displacement in the relative positions of cams 41, 49 and belt 11 at the time when photosensitive unit 10 drivingly engages its mechanical clutch 18*a*, 18*b*, there is no necessity for manual re-adjustment of the position of belt 11 and cams 41, 49, unlike the conventional device. Furthermore, since belt 11 is trained about rollers 13–15 with unit 10 removed from the main body of the reproducing machine, this facilitates adjustment of the position of joint A and that of the respective reproduction-controlling cams 41, 49.

In the embodiment described, reproduction in the A-4 size and the B-4 size are exemplified. The device of the present invention is intended for a reproducing apparatus in which either A-4 size reproduction or B-4 size reproduction is effected. If the reproducing apparatus is of the type in which the sensitive belt stops at a given position for every cycle of reproduction (for example, in a position behind the charger), it suffices to provide only a singlesheet reproduction cam with a single lobe.

It should be understood that the embodiment described above is merely illustrative of the principles of the invention. Many modifications may be made without departure from the spirit and scope of the invention, e.g., the reproduction-controlling system could contain a shift register in place of some of the multiplicity of cams disclosed. Accordingly, the spirit and scope of the invention are as set forth in the following claims.

What is claimed is:

1. In a transfer-type electrophotographic reproducing apparatus having an image-forming system, a photosensitive member unit mounted for withdrawal from and insertion into the apparatus, the unit containing a photosensitive belt having a seam and being trained about a plurality of rollers for rotation to at least one position in an area receiving an image from the image-forming system when reproduction is initiated, and a drive source adapted to engage at least one of the rollers for providing the rotation, the engaging of the drive source with the one roller being conditionally enabled upon insertion of the unit into the apparatus and being disabled upon withdrawal therefrom, the improvement comprising the combination therewith of a device for adjusting a starting position of the belt, including a. a belt-position-adjusting control mounted in the unit for synchronous movement with the belt, b. means actuated by said adjusting control and adapted for engaging the drive source with the one roller to drive the belt while said seam is located within the image-receiving area, c. means actuated by the adjusting control and adapted for disengaging the drive source from the one roller to stop the belt when the seam is located at a given position outside the image-receiving area, d. a reproduction starting means for engaging the drive source with the one roller in response to said initiated reproduction, and e. means inhibiting said reproduction starting means while the seam is located within the image-receiving area, whereby the seam is prevented from occupying the image area during reproduction and reproduction initiation is prevented when the seam is in the image area.

2. A reproducing apparatus as defined in claim 1, further including a cyclical reproduction sequence controller settable to a particular condition indicative of a "reproduction-start" and settable to at least one other condition in response to said initiated reproduction, the controller being adapted to be cycled by a normally-disabled drive member activatable by said drive source; together with first means enabling said drive member in response to said initiated reproduction, and second means enabling said drive member in response to the absence of the particular condition of the controller.

3. a reproducing apparatus as defined in claim 2, further including a source of electrical power and a switch normally disconnected from the power source, the switch when connected being manually operable to initiate reproduction, and means connecting the switch to the power source in response to an AND combination of a discrete position of the belt-position adjusting control and said particular condition of the controller, the discrete position of said adjusting control corresponding to location of the seam in said given position.

4. A reproducing apparatus as defined in claim 3, wherein the belt-position-adjusting control comprises a first cam having at least one lobe and a first two-position switch operable thereby, the sequence controller similarly comprises a second cam having a lobe and a second two-position switch operable thereby, and further including a pair of electrically operated clutches, the engaging of the drive source with the one roller and with the controller-cycling drive member occurring through a respective one of said pair of clutches, each switch being set in a first one of said two positions in response to the presence of the respective cam lobe adjacent thereto and being set in the second of said two positions in the absence of the lobe, said second switch when in said second position enabling the supply of power to the respective clutch to engage thereby the drive source with the controller-cycling drive member to drive said second cam till the lobe thereon sets said second switch to its first position, thereby disabling said drive of the second cam and setting said controller in the "reproduction-start" condition; said first switch when in said second position enabling the supply of power to the respective clutch to engage thereby the drive source with the roller to drive said belt and said first cam till the lobe thereon sets said first switch in the first position, thereby disabling said drive of the first cam and stopping the belt when the seam is in the given position; and said first and second two-position switches being so connected as to enable supply of power to the reproduction initiating switch when said first and second two-position switches are both in said first position.

5. A reproduction apparatus as defined in claim 4, wherein said first switch is connected so as to be in series when the first position of the second switch.

6. A reproduction apparatus as defined in claim 4, wherein the seam has a particular width, the belt has a length which is at least longer by one seam width than N times the corresponding image dimension and said first cam has N lobes cooperating with said first switch, a discrete one of said N lobes setting said first switch in the first position when the seam is is said given position.

7. A reproduction apparatus as defined in claim 6, wherein said image-forming system is adapted to provide images in at least one other size, the belt length being such as to encompass M times the corresponding dimension of said image of the other size, and further including a third cam adjacent to said first cam in said unit and rigidly connected thereto, said third cam having M lobes thereon, one of said M lobes being aligned with said discrete lobe on the first cam; a third two-position switch operable by the lobes of the third cam, and a fourth two-position switch manually operable to control supply of power selectively to the first and third switches, said third switch when in the second position thereof being connected in parallel to the clutch operated by the first switch and correspondingly adapted when selected to enable the supply of power to the last-mentioned clutch, engaging thereby the drive source with the roller to drive said belt and said third cam till a next one of said M lobes sets said third switch to the first position thereof, thereby disabling said drive and stopping the belt with the seam away from the image area, said second and third switches being so connected as to enable supply of power to the reproduction initiating switch when said second and third switches are both in said first position and said fourth switch selectively supplies power to the third switch.

8. A reproducing apparatus as defined in claim 1, wherein the conditionally-enabled drive source comprises a coupling with separable driving and driven ends, said driven end being rigidly affixed to an end of said one roller and said driving end being joined to said drive source through normally-disabled connecting means, said last-mentioned means being enabled alternatively by said reproduction starting means and by said drive source engaging means actuated by the adjusting control.

9. A reproducing apparatus as defined in claim 8, wherein said normally-disabled connecting means is an electrically operated clutch, and further including a source of electrical power for supply to said clutch under control alternatively of said reproduction starting means and by said drive source engaging means actuated by the adjusting control.

10. A reproducing apparatus as defined in claim 1, wherein said belt-position-adjusting control has switch actuating means, and further including switch means having first and second contacts, the synchronous movement of said control and said belt being such that said switch means are set on said second contact while said seam is located within the image-receiving area and set on said first contact by said switch actuating means when the seam is located at said given position outside the image-receiving area, said means engaging the drive source with the one roller being effective in response to setting the switch means on the second contact and said means for disengaging the drive source from the one roller being effective in response to actuating the switch means to change from the second contact to the first contact, and said means from inhibiting said reproduction starting means being effective while the switch means is set on the second contact.

11. A reproducing apparatus as defined in claim 10 wherein the adjusting control switch is a first switch, the reproduction initiating means comprises a further switch and the actuating means for said first switch comprises a cam having at least one lobe cooperating with the first switch, and further including a source of power and an electrically operated clutch for engaging the drive source with the one roller, together with at least a third contact on the first switch connected to the source of power, the first switch being set on the first contact in response to the presence of said lobe adjacent thereto and being set on the second contact when the lobe is remote therefrom, the first switch when set on the second contact enabling supply of power to said clutch to engage the drive source with the one roller and driving the belt and the cam till the lobe thereon sets the first switch on the first contact, thereby disabling the drive and stopping the belt; and the first and further switches being serially connected so as to enable supply of power to the further switch when the first switch is set on the first contact.

12. A reproduction apparatus as defined in claim 11, wherein the seam has a particular width, the belt has a length longer by at least one seam width than N times the corresponding image dimension and said cam has N lobes cooperating with said first switch, a discrete one of the N lobes setting the first switch on the first contact when the seam is in said given position.

13. A reproduction apparatus as defined in claim 12 wherein said image-forming system is adapted to provide images in at least one other size, the belt length being such as to encompass M times the corresponding dimension of said image of the other size, and further including a second cam adjacent to the first-mentioned cam and rigidly connected thereto, the second cam having M lobes thereon, one of the M lobes being aligned with said discrete lobe on the firstmentioned cam; a third switch having first and second contacts and being operable by said M lobes; and a fourth switch, connected to said power source and manually operable to supply power selectively to the first and third switches, said third switch when set on the second contact thereof being connected in parallel to the clutch operated by the first switch and correspondingly adapted, when selected, to enable the supply of power to the clutch, engaging thereby the drive source with the roller to drive said belt and said third cam till a next one of said M lobes sets said third switch to the first contact thereof, thereby disabling said drive and stopping the belt when the seam is located away from the image area; said first and third switches being so connected as to enable supply of power to the reproduction initiating switch when said third switch is set on the first contact and said fourth switch has been operated to supply power to the third switch, and also when said first switch is set on the first contact and said fourth switch has been operated to supply power to the first switch.

* * * * *